US005889452A

United States Patent [19]

Vuilleumier

[11] Patent Number: 5,889,452

[45] Date of Patent: Mar. 30, 1999

[54] MINIATURE DEVICE FOR EXECUTING A PREDETERMINED FUNCTION, IN PARTICULAR MICRORELAY

[75] Inventor: Raymond Vuilleumier, Fontainemelon, Switzerland

[73] Assignee: C.S.E.M. - Centre Suisse D'Electronique et de Microtechnique SA, Neuchatel, Switzerland

[21] Appl. No.: 770,221

[22] Filed: Dec. 19, 1996

[30] Foreign Application Priority Data

Dec. 22, 1995 [FR] France ..... 95 15371

[51] Int. Cl.[6] ..... H01H 51/22

[52] U.S. Cl. ..... 335/80; 257/421

[58] Field of Search ..... 335/78–86, 124, 335/128; 257/415, 421, 422, 686, 687, 688, 689, 690

[56] References Cited

U.S. PATENT DOCUMENTS

| | | | |
|---|---|---|---|
| 4,318,587 | 3/1982 | Grassi | 335/154 |
| 4,668,928 | 5/1987 | Davis et al. | 335/80 |
| 5,398,011 | 3/1995 | Kimura et al. | 335/79 |
| 5,557,132 | 9/1996 | Takahashi | 257/415 |

FOREIGN PATENT DOCUMENTS

| | | |
|---|---|---|
| 0573267 | 12/1993 | European Pat. Off. . |
| 3303665 | 8/1984 | Germany . |
| 9517760 | 6/1995 | WIPO . |

*Primary Examiner*—Lincoln Donovan

[57] ABSTRACT

This miniature relay is obtained by micromachining on a substrate using electroforming, photolithography and/or similar techniques, all its components being obtained on the substrate by integration operations similar to those used for fabricating integrated circuits. A mobile contact (26) is borne by an elastic lever (19) attached, overhanging, to the substrate (1). A lever (19) forms a rocker and is attached to the substrate (1) by means of a deformable connection. At each of its free ends is provided an armature (20, 21) of a magnetic circuit which defines a seat against which the armature can be applied with a magnetic force opposite that generated by the elastic deformation of the lever (19). Each magnetic circuit is additionally provided with at least one coil (10*a*, 10*b*, 11*a*, 11*b*) which can be selectively excited and can generate a second magnetic force, opposite that of the magnetic circuit, in order, when the armature is applied onto its seat, to release the armature associated with this coil and apply the other armature onto its seat by tilting the lever (19).

20 Claims, 6 Drawing Sheets

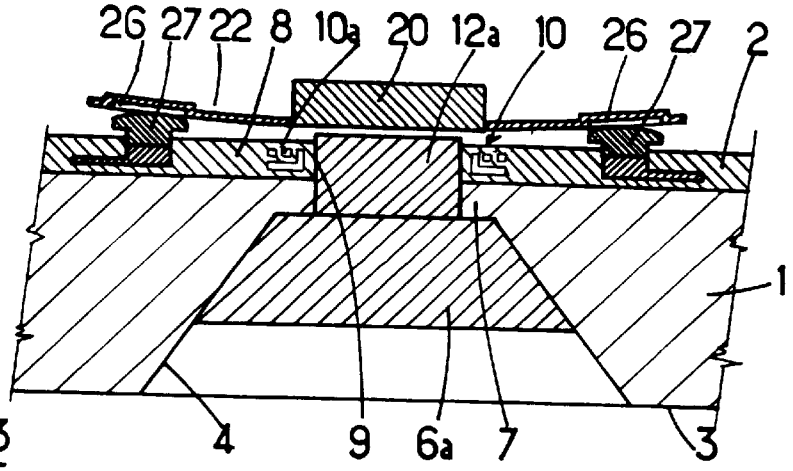
FIG..3
FIG.:4
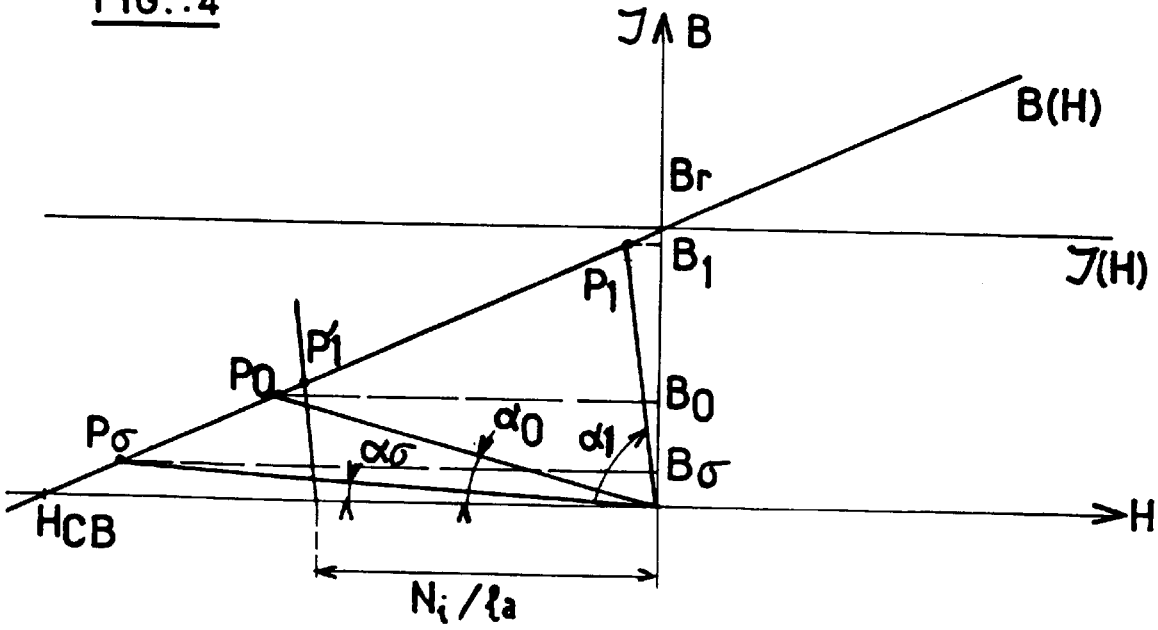

IX
IX 1
2
8
40
13b
51
44
6b
52
13a
36
15
41
38
35
12b
6a
44
12a
39

40
49
48
2
44
13b
45
50
35
38
16
15
17
41
18
37
36
48
50
45
12
44
49
46
47
12a
39

MINIATURE DEVICE FOR EXECUTING A PREDETERMINED FUNCTION, IN PARTICULAR MICRORELAY

BACKGROUND OF THE INVENTION

The present invention relates to miniaturized devices which are intended to fulfill a predetermined function and are obtained by techniques conventionally used for fabricating integrated circuits. Devices of this type may, in particular, be used in the field of microrelays.

DESCRIPTION OF THE PRIOR ART

It has long been known to fabricate miniaturized relays composed of individual components such as the magnetic circuit, the excitation coil, the contacts, the springs and, where appropriate, the permanent magnet. These components are assembled using high-performance robots, which allows the manufacturer to supply a relay with very low cost.

However, with the ever-increasing development of the use of integrated circuits, the need is felt to reduce the dimensions of these electromagnetic relays even further in order to give them a size similar to that of these circuits and thus to combine them directly with their integrated control circuit. However, the conventional fabrication techniques mentioned above are not conducive to advanced miniaturization of this type.

There have therefore been various proposals for achieving such an objective. For example, in an article published in the "Journal of Microelectromechanical Systems", Vol. 2., No. 1, March 1993, Chong H. Ahn and Mark G. Allen describe a micromachined miniaturized relay including a substrate in which a magnetic circuit, coils "wound" on this magnetic circuit, a fixed contact and a mobile contact are integrated. The latter is provided at the free end of a lever which can be deformed elastically so as to make it possible to apply the mobile contact onto the fixed contact by exciting the coil. The "winding" of this coil is produced by the conduction tracks extending over a plurality of integration levels.

Another similar proposal has been put forward by B. Rogge et al. in an article published in "Transducers 95-Eurosensors IX", pages 320 to 323.

In general, the microrelays must satisfy a number of mechanical and electrical criteria in order to be usable in practice, for example in telecommunications or in other fields. Table 1 below sets out and indicates some values which relay manufacturers must adhere to in order, for example, for their product to satisfy the standards set for automatic test equipment (ATE-Security) and in telecommunications.

TABLE 1

| Characteristics | ATE | TELECOM |
|---|---|---|
| Insulation between coils and contacts (kV) | 0.5 to 1.5 | 1.5 to 2.5 |
| Insulation between contacts (kV) | 0.5 to 1.5 | 1.0 to 1.5 |
| Distance between contacts ($\mu$m) | 40 to 210 | 210 to 440 |
| Contact force (g) | $\leqq$4.5 | $\geqq$4.5 |
| Contact resistance ($\Omega$) | 10 to 0.1<br>10 mA to 1 A | 0.02 to 0.05<br>1 A |
| Control power (W) | $\leqq$0.1 | $\leqq$0.1 |
| Number of cycles | $10^7$ to $10^6$ | $10^6$ |
| Switching time (ms) | $\leqq$2 | $\leqq$2 |

It can be seen that these requirements are extremely stringent and seem, a priori, to lie outside the orders of magnitude compatible with the conventional dimensions of integrated circuits.

Among these requirements, those relating to the insulation between contacts and the contact force are particularly difficult to satisfy.

On the one hand, the stipulated value of the insulation requires a large distance between contacts and, on the other hand, the contact force requires a very high magnetic induction $B_0$ to be created in the air gap between the armature and the magnetic circuit, as can be seen from Table 2 below:

TABLE 2

| $B_0$ (T) | 0.2 | 0.3 | 0.4 | 0.5 |
|---|---|---|---|---|
| $p_0$ (g/mm$^2$) | 1.6 | 3.6 | 6.4 | 9.9 |
| $Ni/d_0$ (A-turns/$\mu$m) | 0.16 | 0.24 | 0.32 | 0.40 |

In this table, $p_0$ is the force generated per unit area of the air gap.

This table shows that the number of ampere-turns Ni of the control coil should be very high for an air gap do of only 10 micrometers, and that hundreds or even thousands of turns are necessary if the control power is to be limited to a value of less than 100 mW and the coil is to be kept excited for long periods. Such a requirement is not currently within the technical possibilities available within microtechnology.

SUMMARY OF THE INVENTION

The subject of the invention is to provide a miniaturized device, fabricated by micromachining, which is compatible both with the above requirements and with combining it with an integrated control circuit in close proximity.

The object of the invention is therefore a miniature device for fulfilling a predetermined function, this device being obtained by micromachining on a substrate using electroforming, photolithography and/or similar techniques, in particular for producing miniature microrelays, and comprising means forming a magnetic circuit, at least one excitation coil and means for executing said function under the action of said magnetic circuit, all these elements being obtained on said substrate by integration operations similar to those used for fabricating integrated circuits, said means for executing said function being borne at least partially by an elastic deformable lever attached, overhanging, to said substrate, wherein said lever forms a rocker and is attached approximately at its middle to the substrate by means of a deformable connection, and wherein at each free end of said lever is provided a magnetic armature forming part of said means which form a magnetic circuit, the latter defining a seat against which said armature can be applied with a first magnetic force, generated by said magnetic circuit and opposite that generated by the elastic deformation of said lever, the coil associated with each magnetic circuit being selectively excitable and capable of generating a second magnetic force, opposite that of the magnetic circuit, in order, when the armature associated with this coil is applied onto its seat, to release this armature and apply the other armature onto its seat by tilting said lever.

By virtue of these characteristics, and more particularly when this device is used in its application for a microrelay, the latter may satisfy the stringent operating conditions mentioned above, while being able to be fabricated using integrated circuit technology.

Thus, according to a particularly advantageous application of the invention, the device forms a microrelay comprising at least one fixed contact provided on said substrate and at least one mobile contact borne by said lever forming a rocker, this mobile contact being intended to be applied to said fixed contact when said armature is applied onto its seat.

Thus, by its inherent elasticity, the lever can keep the mobile contact far enough away from the fixed contact, when these contacts are open, to ensure the necessary insulation. In addition, the permanent magnetic flux applies the mobile contact onto the fixed contact, when these contacts are closed, with a pressure which is sufficient to ensure a contact resistance corresponding to working requirements. For this reason, the coils need not remain permanently excited in any of the stable positions of the device.

BRIEF DESCRIPTION OF THE DRAWINGS

Other features and advantages of the invention will emerge from the following description, given solely by way of example and with reference to the appended drawings, in which;

FIG. 3 is a cross-sectional view on a slightly larger scale of the microrelay, taken along the line III—III in FIG. 2 and, in particular, showing a double set of contacts;

FIGS. 4 and 5 are diagrams illustrating the magnetic behavior of the microrelay;

FIG. 11 represents a view in vertical section of a microrelay according to the invention, constructed according to another embodiment.

DESCRIPTION OF THE PREFERRED EMBODIMENTS

Figure 1:
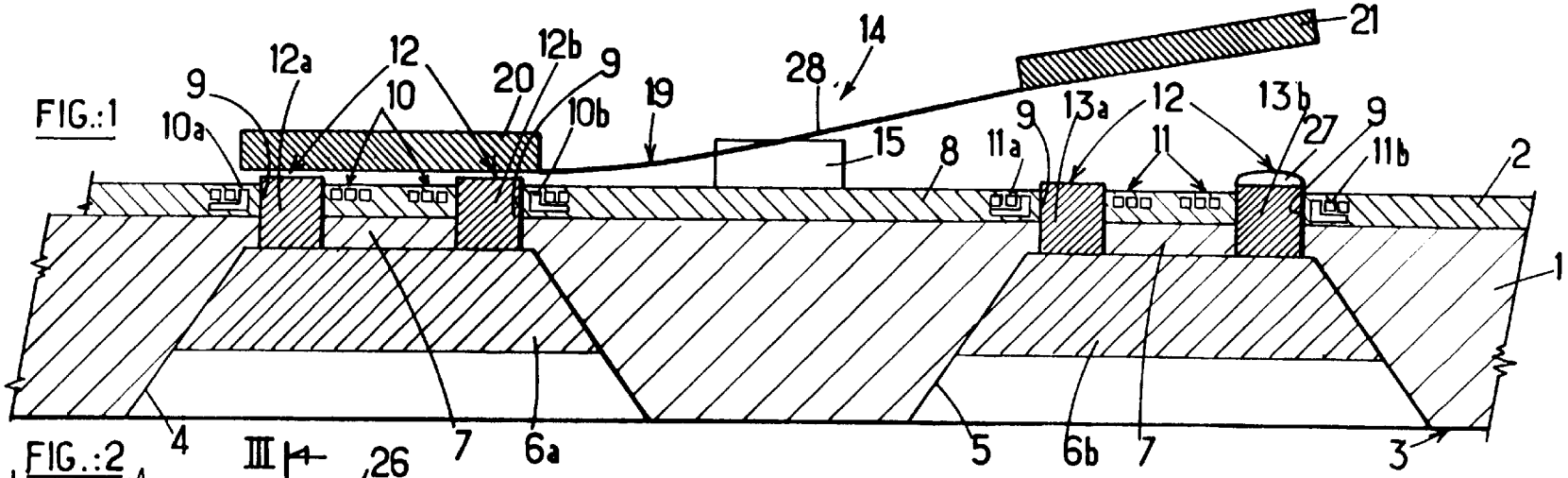
FIG. 1 is a partial sectional view of a substrate in which a device according to the invention has been machined, in its application for a microrelay.
Figure 2:
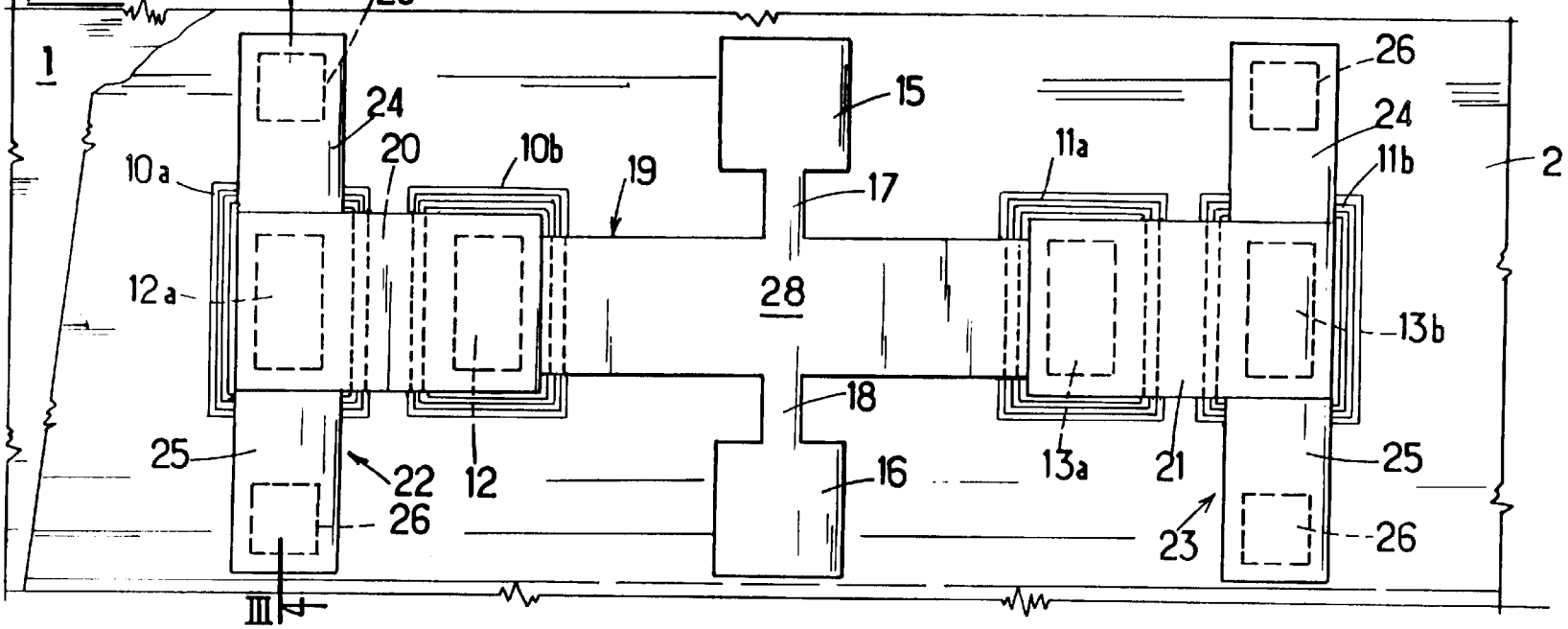
FIG. 2 is a plan view of the microrelay.

The devices according to the invention which will now be described are fabricated using an "above chip" technique, by which it is therefore produced above a substrate 1 preferably made of silicon (FIGS. 1 to 3).

Face 2 of this substrate is arbitrarily referred to as the "upper face" throughout the rest of the description. In addition, to make the figures clearer, some dimensions have been greatly exaggerated.

It will be noted that the photoetching and photolithography techniques used for machining the microrelay are known to the person skilled in the art, who will know how to implement the succession of process steps necessary for this machining.

As a practical example, the longitudinal dimension of the device may be chosen between about 2 and 3 mm approximately.

The lower face 3 of the substrate 1 has two cavities 4 and 5 which, if the substrate is made of silicon, can be machined by anisotropic attack. These cavities are each intended to accommodate a permanent magnet, 6*a* and 6*b* respectively. These magnets 6*a* and 6*b* may be pellets fixed in the respective cavities, or may also be obtained by depositing suitable substances. Each of them has a north pole and a south pole close to the upper surface 2. In the case represented, these magnets extend along the longitudinal dimension of the device (that is to say in the plane of FIG. 1). The bottom of each cavity is formed by a layer 7 of material of the substrate 1 which remains after the cavity is formed.

The upper face 2 is covered with a multilayer of insulator 8, for example silicon oxide. This multilayer 8 is composed of three layers (not drawn individually) which insulate a coil configuration so that each turn of this configuration is isolated from the one which surrounds it. At the center of these coils, openings 9 are formed in the substrate 1 from the face 2 and they are extended in the multilayer of insulator 8.

More precisely, the coil configuration includes two sets 10 and 11 of two flat coils 10*a*, 10*b*, 11*a*, 11*b* produced by metal deposits, for example of aluminum, of suitable shape and embedded in the layer of insulator 8. FIGS. 1 to 3 show their position in bold lines. In the embodiment represented, each coil has a rectangular general shape.

Sets 12 and 13 of pole pieces 12*a*, 12*b* and 13*a*, 13*b* are formed by rectangularly shaped FeNi deposits which fill the openings 9 and which extend slightly beyond the multilayer of insulator 8. Each pole piece is surrounded by its corresponding coil.

FIGS. 1 and 2 show that the assemblies formed by a magnet, a set of coils and a set of pole pieces are separated from one another by a certain distance along the longitudinal dimension of the device. These assemblies are arranged symmetrically with respect to a plane, perpendicular to this longitudinal dimension, relative to a support device 14 formed by two mesas 15 and 16. On the sides which face each other, these mesas are provided with respective torsion arms 17, 18 forming deformable connections with a double lever 19 which extends over substantially the entire length of the device. It is made of an elastically deformable material, FeNi or silicon oxide being suitable for this purpose, and it has a rectangular general shape.

Flux closure pieces or armatures 20 and 21 are respectively provided at the free ends of this lever 19. They are preferably made of FeNi and are dimensioned such that they can cover the corresponding set of pole pieces when they are applied onto them.

FIG. 3 shows a cross-sectional view of one of the ends of the lever 19 and illustrates, in particular, the construction of the means intended to execute the function for which the device according to the invention is designed. In the case described here, these means comprise electrical contact devices, so that the device is a microrelay. Two double contacts 22 and 23 are thus provided respectively at each of the ends of the lever 19 which can electrically form a change-over contact for this microrelay.

Returning to FIG. 3, the preferred embodiment of the microrelay provides two fixed double contacts 22 and 23, FIG. 3 showing the double contact 22, and the contact 23 being exactly identical. The lever 19 bears the mobile contacts of the switch thus formed.

At the end of the lever 19, each armature 20, 21 comprises elastically deformable lateral extensions 24 and 25 which are integrally formed. Pads 26 of a metal which has high electrical conductivity, for example gold, are provided at the end of each of these extensions and are intended respectively to interact with the fixed contacts 27 deposited on either side of one of the pole pieces, in this case 12*a* and 13*b*, in order to minimize the contact resistance. In FIG. 1, one of its fixed contacts 27 can be seen behind the pole piece 13*b*.

According to one variant, lateral extensions 24 and 25 may be made of a different material than the associated armature. It will, however, be observed that elasticity of these extensions is of essential importance so that the contact pads 26 and contacts 27 can be applied on to one another under mechanical stress, and possible wear can thereby be compensated. The elastic deformation of these extensions stores the forces applied onto the contacts, in the form of mechanical potential energies which generate dynamic forces opposite to those applied onto the contacts when they are opened. These dynamic forces are used to overcome the adhesion forces of the contacts.

The coils 10*a*, 10*b*, 11*a*, 11*b* are preferably of the flat type and may each comprise several tens of turns.

The magnetic properties of the magnets 6*a* and 6*b* have decisive importance for the operation of the microrelay according to the invention. A first mode of operation will be described to begin with, this embodiment involving the use of magnets made of a "very hard" material such as samarium-cobalt, platinum-cobalt, ferrite-strontium or other similar materials. The term "very hard materials" means materials which are premagnetized on fabrication and have linear curves, of slope close to $\mu_0$ (see the straight line B(H) in FIG. 4).

The values of the permeance $\Lambda$ of the magnetic circuit can be written using the following notations:

$A_a$ cross-section of the magnet $l_a$ length of the magnet, $A_p$ cross-section of a pole piece 12*a*, 12*b*, 13*a* or 13*b* (FeNi), $l_{p1}$ air gap composed of the sum of the intervals between the pole pieces 12*a* and 12*b*, or 13*a* and 13*b* and the armature 20 or 21, when the latter is applied onto the corresponding contacts by means of the elastic extensions 24 and 25, $l_{p0}$ the same air gap when the armature is separated from the pole pieces after tilting the device:

$$\tan\alpha_1 = -\mu_0 \frac{A_p}{l_{p1}} * \frac{l_a}{A_a} = -\Lambda_1 \frac{l_a}{A_a} \tag{1}$$

$$\tan\alpha_0 = -\mu_0 \frac{A_p}{l_{p0}} * \frac{l_a}{A_a} = -\Lambda_0 \frac{l_a}{A_0} \tag{2}$$

$$\tan\alpha_o = -\Lambda_o \frac{l_a}{A_a} \tag{3}$$

$\Lambda_1$, $\Lambda_0$ and $\Lambda_o$ being respectively the permeance with and without the armature applied and the leakage permeance.

Under these conditions, when the armature is applied, the application force produced by the two poles of the magnet will be:

$$F_1 = 2 * \frac{(B_1 - B_o)^2}{2\mu_0} * A_p = \frac{(B_1 - B_o)^2}{\mu_0} * A_p \tag{4}$$

and the working point on the curve (FIG. 4) will be $P_1$.

On the other hand, when the armature is separated from the pole pieces, the force produced by the two poles will be:

$$F_0 = 2 * \frac{(B_0 - B_o)}{2\mu_0} * A_p = \frac{(B_0 - B_o)}{\mu_0} * A_p \tag{5}$$

Since $F_1 >> F_0 + F_m$, where $F_m$ is the sum of the mechanical forces (forces exerted on the lever 19 by its attachments and by the elastic deformation), the armature which was applied at the time in question onto the pole pieces will remain applied so long as the corresponding coils are not acted upon.

For the microrelay to tilt, it is necessary to pass a current i through the coils on the side where the armature is applied onto the pole pieces. This current produces a demagnetization field equal to $Ni/l_a$ (N being the number of turns of the coils in question), which displaces the working point from $P_1$ to $P_{1'}$. Under these conditions, at $P_{1'}$ $$F_{1'} < F_0 + F_m \tag{6}$$

which tilts the lever 19 and the microrelay assumes the opposite position.

The demagnetization field must, however, remain limited to a value such that the magnet will not be demagnetized (in other words, $P_{1'}$ can move along the straight demagnetization line beyond the point $P_0$, but without going too far).

It should, however, be pointed out that very hard magnetic materials require a relatively high number of ampere-turns Ni in order to obtain sufficient excursions in the induction B and to make it possible to generate the necessary forces on the contacts.

It is known that less hard magnetic materials demagnetize in the presence of a reverse magnetic field by following nonlinear induction curves B(H). It is therefore preferable to choose these materials in order to obtain more convenient values of Ni. However, in that case driving of the coils 10*a*, 10*b* and 11*a*, 11*b* will be slightly more complicated, because it is then necessary for this control to produce magnetization and demagnetization pulses.

Hard and semihard magnetic materials are additionally advantageous because they are easier to deposit using currently known electrolytic processes. In addition, they need not be magnetized on fabrication. It should be noted that, among other materials, cobalt-tungsten, cobaltiron and cobalt-nickel-phosphorus are well-suited for this use.

In the application envisaged for the present invention, preferred materials are ones having fairly small coercive forces, for example of the order of 10 kA/m, i.e. approximately 125 oersteds. They can thus be magnetized or demagnetized by suitably choosing the direction of the current in the relevant coils of the microrelay. In the context of the invention, a suitable induction value for the magnetization field may be 2 to 3 times the coercive force.

Figure 5:
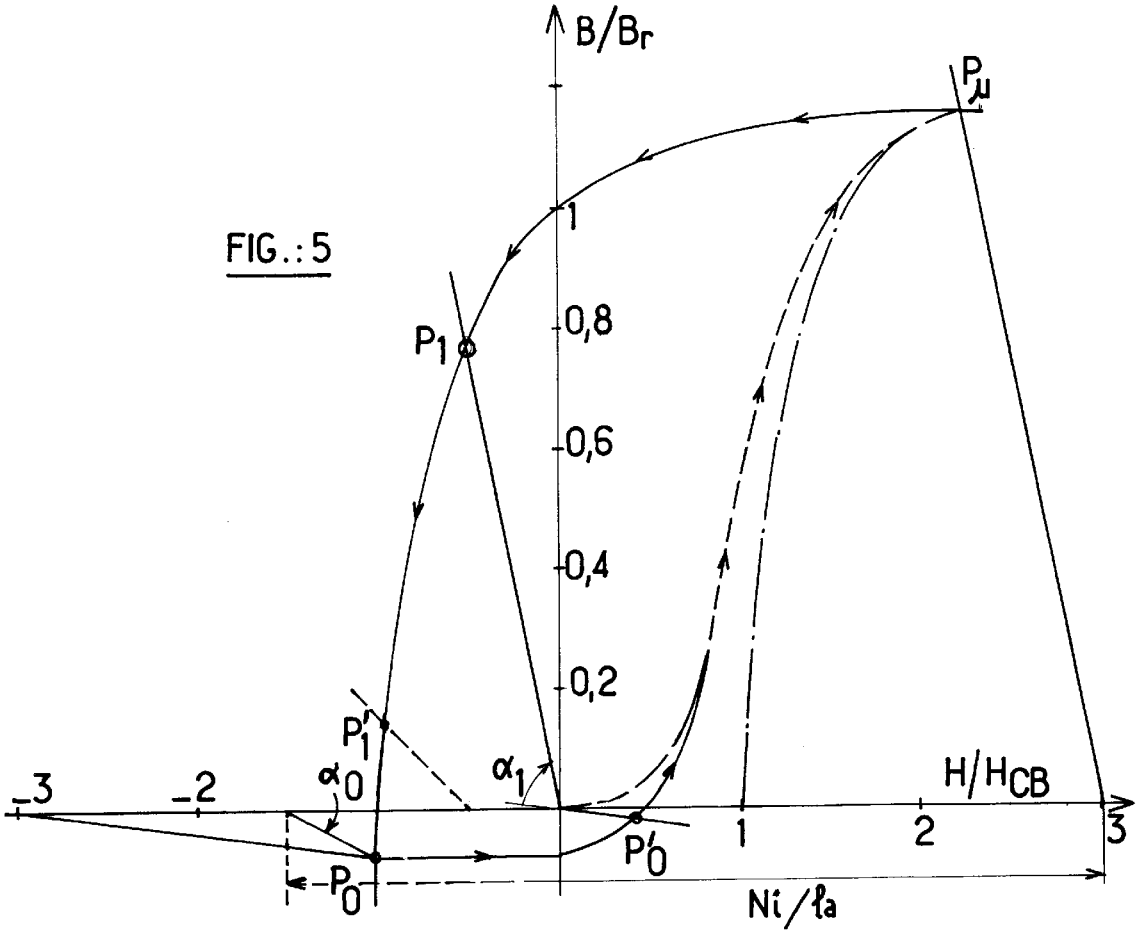

FIG. 5 represents the magnetization/demagnetization curve used in this illustrative case. In the example represented, it is assumed that there is substantially no air gap, which makes it possible to minimize leakage. This is technically possible and the effect of the air gaps can thus become negligible ($\tan \alpha_o = 0$).

It is also arbitrarily assumed that the armature 20 situated on the left-hand side in FIGS. 1 and 2 has previously been applied onto the corresponding pole pieces 12*a* and 12*b*. To do this, it was necessary to apply a magnetization field in $Ni/1_a$ to the magnet 6*a* by passing a current of suitable direction through the coils 10*a* and 10*b*. This may be a current pulse with a duration of a few milliseconds. The result of this is that the working point of this magnet is at $P_1$ on the curve in FIG. 5.

The application force produced is then as defined in equation (4) above. In contrast to the case in FIG. 4, the force $F_0$ on the right-hand side of the device is zero because the magnet 6*b* is only weakly magnetized. Consequently, since $F_1$>>F m, the left-hand armature 20 remains applied onto its pole pieces 12*a* and 12*b* after the left-hand side has been magnetized.

In order to tilt the device, a demagnetization current with predetermined amplitude and duration has to be passed through the left-hand coils 10*a* and 10*b*, and a magnetization current simultaneously be passed through the right-hand coils 11*a* and 11*b*, with an amplitude two or three times greater than, but with the same duration as the demagnetization current.

This has the effect, on the left:

- that the working point of the magnet moves from the point $P_1$ on the curve to the point $P_{1'}$, where $F_{1'}=F_m$;
- that the left-hand contact or contacts open under the simultaneous action of Fm and the release of the mechanical potential energies stored in the lateral extensions 24 and 25;
- that the air gap between the armature 20 and the pole pieces 12*a* and 12*b* increases considerably, which greatly reduces the slope of the straight working line in the diagram in FIG. 5 (tan $\alpha_0$);
- that the point $P_{1'}$ moves to the point $P_0$ then, when the number of ampere-turns Ni=0, the point $P_0$ moves to the point $P_{0'}$;

and on the right:

- that the point $P_0$ moves to the point $P_\mu$ then, when the number of ampere-turns Ni=0, the point $P_\mu$ moves to the point $P_1$.

It will be observed in FIG. 1 that the lever 19 has two thick regions forming the armatures 20 and 21 and a thin strip 28 which joins these two armatures together. The torsion arms 17 and 18 are attached to this strip 28 approximately at its middle.

The thickness of the armatures 20 and 21 is determined by the magnetic flux which must be able to pass through them. As represented in FIG. 1, this thickness is relatively large compared to that of the strip 28. The result of this is that the armatures 20 and 21 are relatively rigid.

Moreover, it has already been pointed out that, when the contacts are open, a certain distance (>100 $\mu$m) between them must be kept in order to guarantee the required electrical insulation. Since the armatures are substantially rigid, it is therefore necessary for the region 28 to be flexible, which moreover affords a further advantage, namely of amplifying the movement between the torsion arms 17 and 18 and the outer ends of the armatures 20 and 21.

Figure 6:
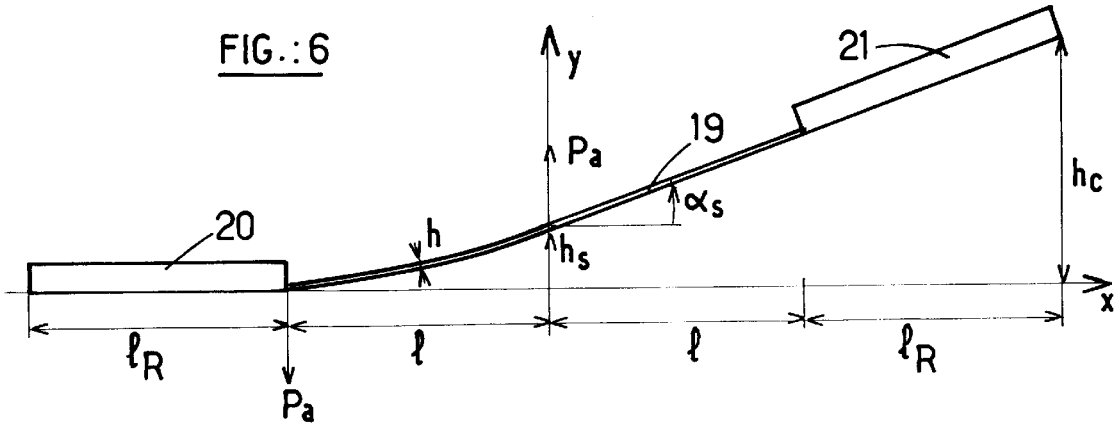
FIG. 6 is a diagram illustrating the mechanical behavior of the microrelay according to the invention.

Referring to FIG. 6, this amplification can be theoretically described as follows.

In order to deform the strip 28, the torsion arms 17 and 18 installed at a height $h_s$ must sustain a force $$P_a = 3EI\frac{h_s}{l^3} \text{ with } I = \left(\frac{h^3 b}{12}\right)$$

which is the moment of inertia of the flexible strip, b and h being respectively the width and thickness. E is the modulus of elasticity of this strip. It will be noted that $P_a$<<$F_{1p}$, $F_{1p}=F_1/2$ being the force of a single magnetic pole.

When the contacts are opened, their distance hc can be determined by $$h_c = h_s + \tan\alpha_s(l + l_R) \text{ where } \tan\alpha_s = \frac{3}{2}\ \frac{h_s}{l} \text{ hence:} \tag{7}$$

$$h_c = \left(5 + 3\frac{I_R}{l}\right)\frac{h_s}{2}$$

If, by way of example, $l_R$=1 is chosen, then $h_c$=4$h_s$, which is a feasible value for satisfying the insulation requirements.

Figures 7, 8:
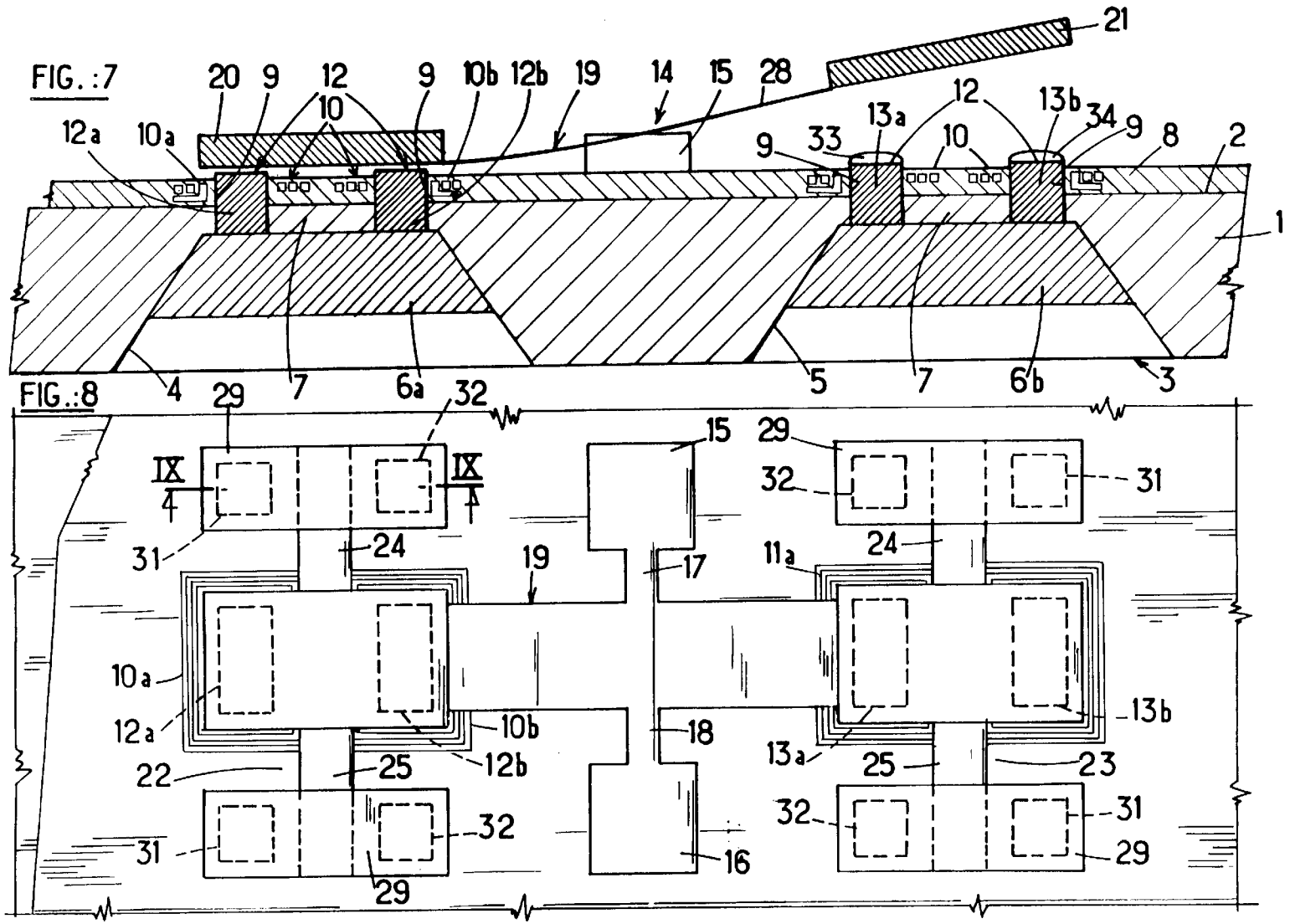
FIG. 7 is a sectional view of a microrelay according to another embodiment of the invention.
FIG. 8 is a plan view of the microrelay in FIG. 7.
Figure 9:
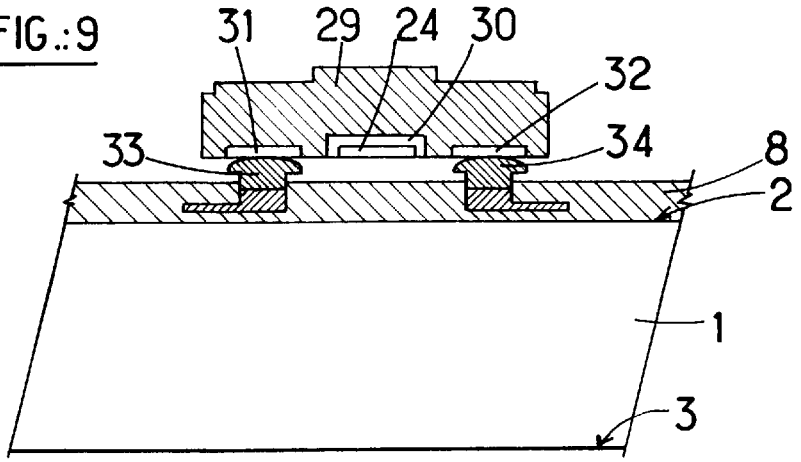
FIG. 9 is a sectional view of the microrelay in FIGS. 7 and 8, taken along the line IX—IX in FIG. 8.

FIGS. 7 to 9 show another embodiment of a microrelay according to the invention, which differs from the embodiment in FIGS. 1 to 3 by the arrangement of the contacts. Specifically, at its free end, each cross piece 24 and 25 here has a support bridge 29 which is fixed by means of a layer of insulator 30. The support bridge 29 is made of FeNi, for example, and bears two contact pads 31, 32 intended to interact with two contacts 33 and 34, respectively, formed in the insulation layer 8 of the substrate 1, beyond which they extend by a certain distance.

Thus, this embodiment makes it possible, in a single operation, to respectively close or open four electrical circuits which will be insulated from the double lever 19 by the presence of insulating layers 30.

Figures 10, 11:
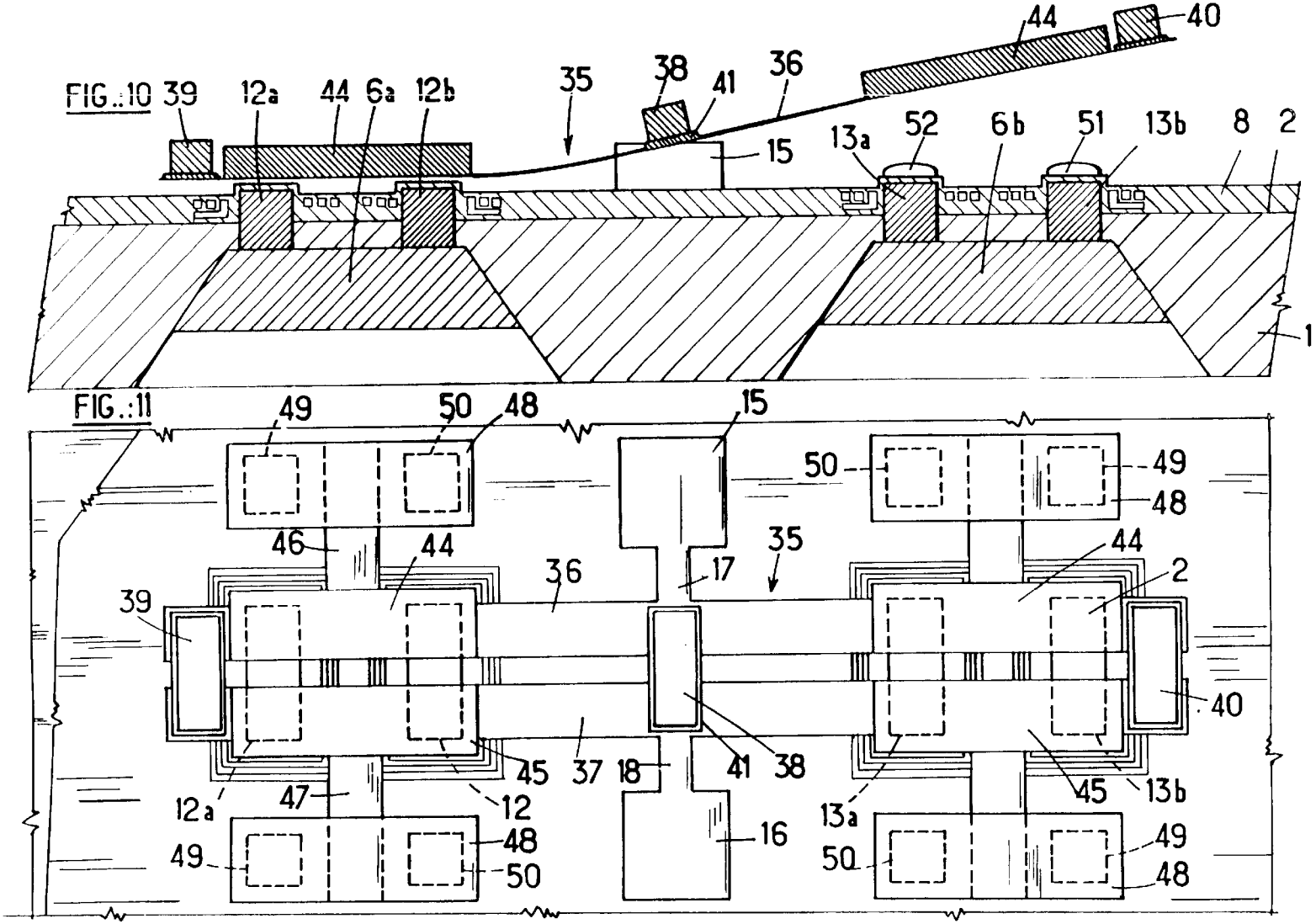
FIG. 10 is a sectional view of another embodiment of the invention.
FIG. 11 is a plan view of the microrelay in FIG. 10.

FIGS. 10 and 11 show another embodiment of the microrelay according to the invention, in which a double lever 35 is provided, itself formed by two strips 36 and 37 extending parallel to one another.

These strips are borne by the two mesas 15 and 16, by means of the torsion arms 17 and 18. They are secured to one another by means of three connecting blocks 38, 39 and 40, provided respectively at the same level as the torsion arms 17 and 18 and at the two ends of the parallel strips 36 and 37. These blocks are, for example, made of FeNi and they are insulated from the strips by means of respective layers of insulator 41, 42 and 43.

At each end, the strips also bear a separate armature 44 and 45, respectively, interacting with the respective pole pieces 12*a*, 12*b*, 13*a* and 13*b*. In addition, each strip bears two crosspieces 46, 47 in turn securing support bridges 48 and pads 49, 50 which are interacting with fixed contacts 51, 52 in the layer of insulator 8. The circuits which these assemblies may make or break can thus be electrically separated from one another.

Figure 12:
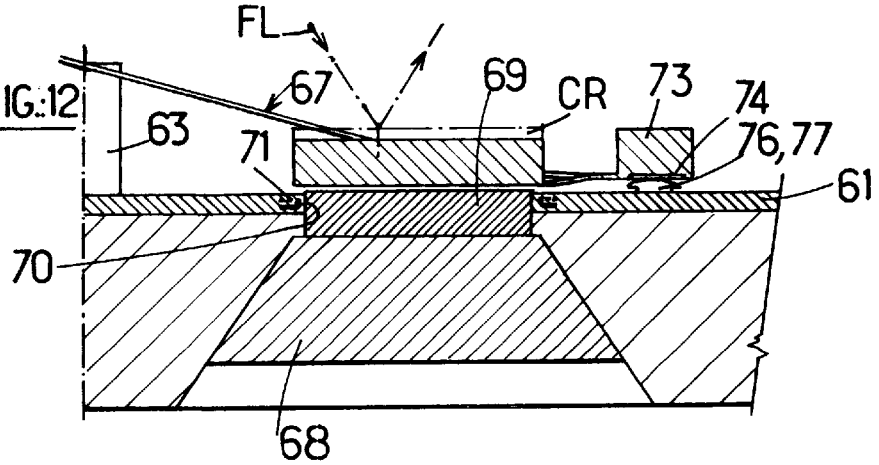
FIGS. 12 and 13 show another embodiment of the device according to the invention, in particular illustrating a particular application.
Figure 13:
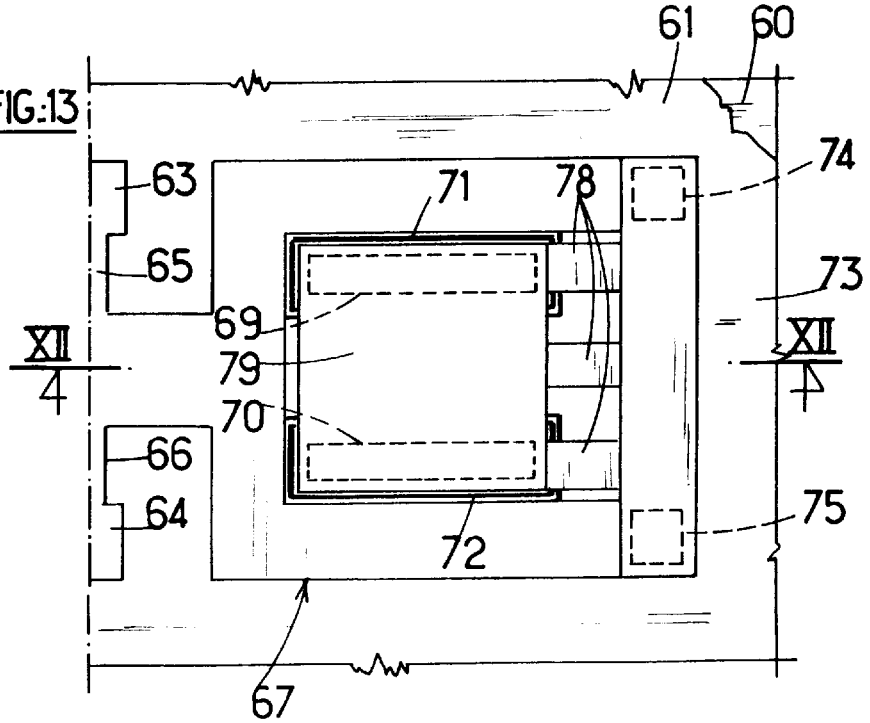

FIGS. 12 and 13 show another embodiment of the microrelay according to the invention.

In this case, a substrate 60 is covered with a layer of insulator 61 on one of its faces and has a cavity 62 opening on the other face.

This microrelay also includes two mesas 63, 64 from which torsion arms 65 and 66 extend, the latter supporting a strip 67 in the shape of a double fork, only one 67A of its forks being represented in the drawings.

A magnet 68 is arranged in the cavity 62 and interacts with two pole pieces 69 and 70 passing through openings 70 made in the substrate 60 and the layer of insulator 61. Each of these pole pieces is surrounded by a coil 71 and 72, respectively, embedded in the layer of insulator 61.

The free ends of the branches of the fork 67A bear a support bridge 73 equipped with contact pads 74, 75 provided at its ends. These pads interact with fixed contacts 76, 77.

The support bridge 73 is formed integrally with the fork-shaped strip 67 and also with three connection tabs 78 which extend from the support bridge 73 inward between the branches of the fork 67A. From the mechanical point of view, these connection tabs extend these branches so that, in the present embodiment, the strip 67 may be considered to be folded onto itself, while fulfilling exactly the same functions as the strips described in conjunction with the previous embodiments. The principal advantage of this folded strip configuration consists in that, overall, the device takes up less space on the substrate than those described above.

The connection tabs are attached to an armature plate 79 which, when the contacts 76 and 77 on the corresponding side are closed, is applied onto the pole pieces 69 and 70 by means of the support bridge 73. It will be noted that, in this closed position, the connection tabs 78 are under elastic stress while acting in the same direction as the fork 67A, which is clearly visible in FIG. 12. The elastic forces with which the fork 67A and the tabs 78 are stressed consequently so as to improve operation of the assembly when the armature 79 is repelled by the magnetic field generated to open the contacts.

FIG. 12 also illustrates that the invention is not limited to its application for a microrelay.

Indeed, in a different application example which is not intended to imply any limitation and which could be envisaged in all the variants described above, in place of the fixed contacts and the mobile contacts, or in conjunction with the use of these contacts, the mobile element of the magnetic circuit could be coated with a reflective layer CR (drawn in dot-dashed lines) which can intercept a light beam FL and reflect it selectively to a target (not shown) depending on the position of the tilting lever. Of course, the same mobile element could also merely intercept the beam without reflecting it, in which case the reflective layer would not be necessary.

According to another variant of the invention, applicable more especially for a microrelay, only a single double contact may be provided (see FIG. 1), the relay then being merely a simple switch. According to yet another variant, the electrical contact or contacts could be single contacts, without being duplicated on either side of the lever 19.

Still in the context of application for a microrelay, it would also be possible, on one side or on either side of the lever 19, to provide a pair of insulated contacts which would then be bridged in the corresponding position of the relay.

Finally, in all the embodiments described hereabove, the substrate itself may be made of a magnetic material whereby the regions of the substrate underlaying the coils are locally magnetized for substituting the distinct permanent magnets.

According to the above description, it can therefore be seen that the invention provides a device for fulfilling a predetermined function and, in particular, a microrelay, which has similar dimensions to contemporary integrated circuit chips and which, in particular, makes it possible to satisfy the stringent requirements demanded of the relays currently used in high-performance technology.

I claim:

1. A microrelay for performing a predetermined function, and formed by micromachining on a substrate, comprising two magnetic circuits, at least one excitation coil associated with lack of said magnetic circuits and means for executing said function under the action of said magnetic circuits, said means for executing said function including an elastic deformable lever attached to and overhanging said substrate, said lever forming a rocker, a deformable connection attaching said lever approximately at its middle to the substrate, and two magnetic armatures disposed, one each, proximate the free ends of said lever, said magnetic armatures each forming part of one of said magnetic circuits, each magnetic circuit including a seat against which said armature can be held with a first magnetic force generated by said magnetic circuit, said force being opposite in direction to that generated by the elastic deformation of said lever each of said coils being selectively excitable for generating a second magnetic force, opposite that of the associated magnetic circuit, said second magnetic force acting, when the armature of the associated magnetic circuit is being held to the seat of such magnetic circuit together with the force generated by the elastic deformation of said lever, to release this armature and apply the other armature onto its seat by tilting said lever.

2. The microrelay as claimed in claim 1, wherein said means for executing said function comprise at least one fixed contact provided on said substrate and at least one mobile contact borne by said lever forming a rocker, said mobile contact being in electrical contact with said fixed contact when said armature is held onto its seat.

3. The microrelay as claimed claim 1, wherein each magnetic circuit comprises a permanent magnet disposed in said substrate made of a very hard magnetic material.

4. The microrelay as claimed in claim 1, wherein each magnetic circuit comprises a magnet disposed in said substrate made of a hard or semi-hard magnetic material.

5. The microrelay as claimed in claim 3 wherein said magnet includes a pellet mounted on the substrate.

6. The microrelay as claimed in claim 4 wherein said substrate is made of a magnetic material and wherein said magnet is formed by a magnetized region of said substrate.

7. The microrelay as claimed in claim 4, wherein said coils are designed to be additionally excited for generating said first magnetic force.

8. The microrelay as claimed in claim 2, wherein at least one mobile electrical contact is provided proximate each of the ends of said lever.

9. The microrelay as claimed in claim 2, further including a connecting element secured to said lever and extending transversely with respect thereto wherein each of said mobile electrical contacts is borne by said connecting element secured to said lever and extending transversely with respect thereto.

10. The microrelay as claimed in claim 9, wherein said connecting element is elastically deformable and is elastically stressed when said mobile contact is applied onto said fixed contact under the action of said first force.

11. The microrelay as claimed in claim 9, wherein said connecting element is electrically insulated from said lever.

12. The microrelay as claimed in claim 8, wherein two mobile contacts are provided, one of the ends of said lever, and are situated on either side thereof, and wherein the lever is made of two elongated parts extending parallel beside one another and electrically insulated from one another.

13. The microrelay as claimed in claim 8, wherein said lever is electrically insulated from said substrate.

14. The microrelay as claimed in claim 1, wherein said lever is folded onto itself on either side of its point of attachment to said substrate.

15. The microrelay as claimed in claim 1, wherein said magnetic circuit comprises pole pieces forming the seat of the corresponding armature.

16. The microrelay as claimed in claim 15, wherein each of said pole pieces is surrounded by an excitation coil.

17. The microrelay as claimed in claim 1, wherein said deformable connection includes a torsion arm.

18. The microrelay as claimed in claim 5 wherein, 20 said substrate includes cavities in one of its faces for housing said magnets, and wherein the remainder of each magnetic circuit is arranged on the opposite face of said substrate.

19. The microrelay as claimed in claim 18, wherein each said magnetic circuit comprises pole pieces forming the seat of the corresponding armature, each of said pole pieces being surrounded by one of said excitation coils (10*a*, 10*b*, 11*a*, 11*b*, 71, 72), and further including a layer of insulator on said opposite face of said substrate, in which layer said coils and said pole pieces are embedded.

20. The microrelay as claimed in claim 1, wherein said function consists in acting on a beam of light rays, and wherein said armature is disposed so as to intercept said beam in order to interrupt it or reflect it as a function of the position of said lever.

* * * * *